US008844724B2

(12) United States Patent
Andrews et al.

(10) Patent No.: US 8,844,724 B2
(45) Date of Patent: Sep. 30, 2014

(54) SYSTEM AND METHOD FOR DISTRIBUTING MEDICINE

(75) Inventors: Mary Ann Andrews, Danville, CA (US); Charles Andrews, Danville, CA (US)

(73) Assignee: Pillbox Products LLC, Danville, CA (US)

( * ) Notice: Subject to any disclaimer, the term of this patent is extended or adjusted under 35 U.S.C. 154(b) by 0 days.

(21) Appl. No.: 13/300,570

(22) Filed: Nov. 19, 2011

(65) Prior Publication Data

US 2012/0160730 A1 Jun. 28, 2012

Related U.S. Application Data

(60) Provisional application No. 61/426,737, filed on Dec. 23, 2010.

(51) Int. Cl.

| | |
|---|---|
| ***B65D 83/04*** | (2006.01) |
| ***A61J 7/04*** | (2006.01) |
| ***A61J 7/00*** | (2006.01) |

(52) U.S. Cl.

CPC *A61J 7/0084* (2013.01); *A61J 7/04* (2013.01); *A61J 2205/30* (2013.01); *A61J 2205/40* (2013.01)

USPC ..... 206/534

(58) Field of Classification Search

CPC ..... A61J 7/04; A61J 1/03; B65D 43/162; B65D 43/267; B65D 83/0445; B65D 2585/56

USPC ..... 206/534, 535, 536, 538, 540

See application file for complete search history.

(56) References Cited

U.S. PATENT DOCUMENTS

| | | | | | |
|---|---|---|---|---|---|
| 3,638,603 | A | * | 2/1972 | Conover | 116/308 |
| 3,712,533 | A | * | 1/1973 | Skillen | 229/244 |
| 4,058,210 | A | * | 11/1977 | Mitchell | 206/372 |
| 4,253,572 | A | * | 3/1981 | Halbich | 206/538 |
| 4,285,556 | A | * | 8/1981 | Loeffel | 312/244 |
| 4,640,560 | A | * | 2/1987 | Blum | 312/234.1 |
| 4,735,318 | A | * | 4/1988 | Keffeler | 206/532 |
| 4,749,085 | A | | 6/1988 | Denny | |
| 4,770,297 | A | * | 9/1988 | Chang | 206/379 |
| 4,793,492 | A | * | 12/1988 | Halbich | 206/538 |
| 4,915,256 | A | * | 4/1990 | Tump | 221/5 |
| 5,011,018 | A | * | 4/1991 | Keffeler | 206/532 |
| 5,267,650 | A | * | 12/1993 | Gilbilisco | 206/534 |
| 5,671,846 | A | * | 9/1997 | Frank | 206/541 |
| 5,782,359 | A | * | 7/1998 | McAllister et al. | 206/538 |
| 5,806,670 | A | * | 9/1998 | Harlan et al. | 206/232 |
| 5,947,329 | A | * | 9/1999 | Bailey | 221/288 |
| 5,954,225 | A | * | 9/1999 | Powe | 221/2 |

(Continued)

*Primary Examiner* — Steven A. Reynolds
*Assistant Examiner* — King M Chu
(74) *Attorney, Agent, or Firm* — Antero & Tormey LLP; Crystal Fernandes; Pete Tormey

(57) ABSTRACT

A device having a compartment with cavities disposed on opposite sides, each cavity disposed for receiving at least one pill case. The pill cases are disposed on mounts in the cavity using pressure to hold in place. A drawer is disposed in a cavity opening on a top surface. The device is help upright by a support structure to allow a user to access pill cases from each side of the device. The pill cases may be disposed between rails. An indicator may be attached to the rails thus allowing a user to indicate which pill cases, or compartments in pill cases do not have an adequate supply medicine.

1 Claim, 6 Drawing Sheets

(56) References Cited

U.S. PATENT DOCUMENTS

| | | | | |
|---|---|---|---|---|
| 6,000,546 | A * | 12/1999 | Noble | 206/538 |
| 6,227,371 | B1 * | 5/2001 | Song | 206/534 |
| 6,382,410 | B1 | 5/2002 | Magid et al. | |
| 6,769,545 | B1 * | 8/2004 | Mallams | 206/534 |
| 6,905,020 | B2 * | 6/2005 | Chang | 206/373 |
| 7,267,228 | B2 * | 9/2007 | Keffeler et al. | 206/532 |
| 7,353,939 | B2 * | 4/2008 | Coe et al. | 206/232 |
| 7,494,012 | B1 * | 2/2009 | Priebe et al. | 206/538 |
| 7,568,301 | B1 * | 8/2009 | Zemlansky et al. | 40/358 |
| 7,591,382 | B2 * | 9/2009 | Brock | 211/10 |
| 7,661,530 | B1 | 2/2010 | Hewitt | |
| 7,854,326 | B1 * | 12/2010 | Beckett | 206/534 |
| 2003/0043026 | A1 * | 3/2003 | Noble et al. | 340/309.15 |
| 2007/0138048 | A1 * | 6/2007 | Coe et al. | 206/528 |
| 2009/0114562 | A1 * | 5/2009 | Noble et al. | 206/538 |
| 2009/0149989 | A1 * | 6/2009 | Dow | 700/242 |
| 2010/0314283 | A1 * | 12/2010 | Noble et al. | 206/534 |

* cited by examiner

SYSTEM AND METHOD FOR DISTRIBUTING MEDICINE

CROSS REFERENCE TO RELATED APPLICATION

This application claims the benefit of provisional patent application No. 61426737 entitled "System and Method for Distributing Medicine" by the same inventor filed on Dec. 23, 2010 which is incorporated by reference as if fully set forth herein.

BACKGROUND

The present invention relates generally to medicine distribution, and more particularly to a system and method for storing medicine for scheduled delivery to a patient.

Pill dispensers conventionally can accommodate several pills for multiple times and days. Typically the dispensers lay flat. To be capable of accommodating multiple times and days, traditional dispensers contain a larger quantity of compartments, thereby increasing the size of the dispenser and the occupying more space on the user's counter, dresser, or table. Moreover when using the larger dispensers, if a user would like to retrieve the pills from a single compartment the whole dispenser must be inverted if the pills cannot be retrieved by hand.

People who rely on large amounts of medicine are often seriously infirm and may have limited abilities such as diminished memory, reduced sight and loss of motor controls. Being so, simple tasks such as taking a morning dose of medicine may be challenging and errors can have a significant negative impact on their health.

As such, what is needed is a system and method to store medicine, such as pills, in a space saving structure with removable compartments to better aid the user and avoid confusion.

SUMMARY

Disclosed herein is a system and method for distributing medicine. The system for distributing medicine is a device comprising at least a carrying compartment, said carrying compartment may have foundational footing to rest upon and having lateral grips for user convenience. Additionally, said carrying compartment may have a first mount, a second mount and a set of mounting rails on a first side and having a first mount, a second mount and a set of mounting rails duplicated on an opposite second side. Said first mount, second mount and mounting rails may be formed to receive one or more pill cases. This allows for an upright dual sided system for distributing medicine, which saves space and allows for a larger quantity of medicine to be stored.

Said pill cases may be equipped with interior compartmental indicators to be set by the user when medicine dosage is low or missing or needs to be replenished. In order to aid the user in taking medicine and avoid confusion, the carrying case and the pill cases have indicia to describe the day and time to indicate when the medicine should be taken.

In addition, the carrying compartment may have the capacity to hold a drawer case. The drawer case may be inserted into a channel located in the middle of the carrying compartment. The drawer case may be removed from the carrying compartment and opened to reveal a compartment, which may hold prescriptions, a note pad, or other items necessary for a medicinal regimen. This drawer case may eliminate the possibility of forgetting to refill medication or losing prescriptions.

The construction and method of operation of the invention, however, together with additional objectives and advantages thereof will be best understood from the following description of specific embodiments when read in connection with the accompanying drawings.

DETAILED DESCRIPTION

Figure 1:
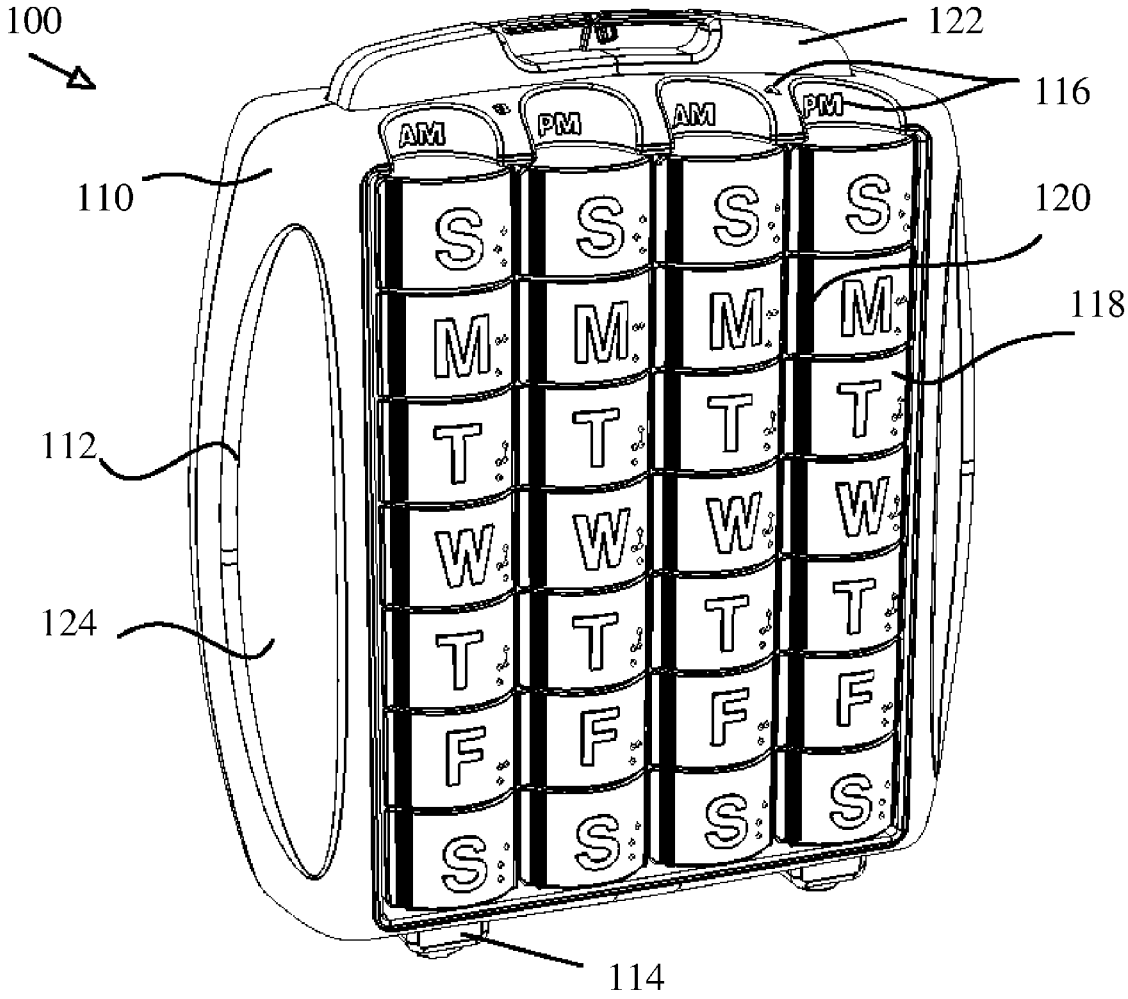
FIG. 1 illustrates a perspective view of a system for distributing medicine according to certain aspects of the current disclosure.

Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Lexicography

Read this application with the following terms and phrases in their most general form. The general meaning of each of these terms or phrases is illustrative, not in any way limiting.

The term "medicine" generally refers to drugs, small molecules, therapies, potions, chemicals and the like used by patients to regulate health.

The term "pill case" generally refers to a device with compartments, which hold medicine to be dispensed over multiple days and/or times with labels for such on the compartments.

The term "grip" generally refers to a grasp, hold, control, or the like by a user's hands.

System Elements

FIG. 1 illustrates a perspective view of a system for distributing medicine 100 according to aspects of the current disclosure. In FIG. 1 is a carrying compartment 110, which is formed to have a handle 112 disposed on either or both sides of the carrying compartment 110. The carrying compartment 110 stands upon footing 114. The carrying compartment 110 is created with indicia 116. The carrying compartment 110 includes mounts (not shown) for holding multiple pill cases 118 in a pill case enclosure. The pill cases 118 are coupled to one or more indicators 120. The carrying compartment 110 is also formed to hold a drawer case 122 disposed in a cavity (not shown). In FIG. 1, the system for distributing medicine 100 is dual sided providing the ability to hold several pill cases 118 on each opposing side. Accordingly the indicia 116 may be duplicated on the reverse side.

The inventor contemplates using plastic to form the system for distributing medicine 100. This would allow the system for distributing medicine 100 to be durable, cost effective, and lightweight. However, one skilled in the art would recognize that other materials may be used to effectuate a lightweight, durable, and easy to construct system for distributing medicine. For example a designer may choose any material capable of forming the system for distributing medicine such as other plastics, wood, ceramic or other suitable material. One having skill in the art will also recognize that the compartment and other parts may be formed using conventional processes such as injection molding, rotational molding, and thermoforming. Parts may be formed wherein they snap or pressure fit together.

Handle

In the FIG. 1 there may be a handle 112 formed with an indentation or other disruptive surface for ease of grip by a user. The handle 112 may include an indentation 124 that is sized proportional to a user's hand. Alternatively a hook, rail, eyelet, protuberant handle and the like may be employed. In addition the handle 112 may include an ornamental design.

Footing

In the FIG. 1 a footing 114, may be placed along a bottom side of the carrying compartment 110 to raise the carrying compartment 110 off a surface on which it sits. The footing 114 need not be restricted to the depicted location and may be placed in any position to balance and elevate the carrying compartment 110. One having skill in the art will recognize that raising the carrying compartment off a surface may be effectuated using legs, felt pads and the like.

The inventor contemplates using plastic to form the footing 114. This would allow the footing 114 to be durable, cost effective, and lightweight. However, one skilled in the art would recognize that other materials may be used to effectuate a lightweight, durable, and easy to construct footing. For example a designer may choose any material capable of forming the system for distributing medicine such as other plastics, rubber, wood, ceramic or other suitable material.

Indicia

FIG. 1 illustrates an embodiment of indicia 116. In the FIG. 1, the indicia 116 are placed atop the carrying compartment 110. The indicia 116 are placed above each of the pill cases 118 to indicated date or time at which the medicine should be dispensed. The indicia 116 may include but are not limited to text, icons, Braille, or other symbols such as a sun to indicated A.M. or a crescent moon to indicate P.M. The indicia 116 may be printed, affixed, embossed, or the like onto the carrying compartment 110.

References in the specification to "one embodiment", "an embodiment", "an example embodiment", etc., indicate that the embodiment described may include a particular feature, structure or characteristic, but every embodiment may not necessarily include the particular feature, structure or characteristic. Moreover, such phrases are not necessarily referring to the same embodiment. Further, when a particular feature, structure or characteristic is described in connection with an embodiment, it is submitted that it is within the knowledge of one of ordinary skill in the art to effect such feature, structure or characteristic in connection with other embodiments whether or not explicitly described. Parts of the description are presented using terminology commonly employed by those of ordinary skill in the art to convey the substance of their work to others of ordinary skill in the art.

Carrying Compartment

Figure 2:
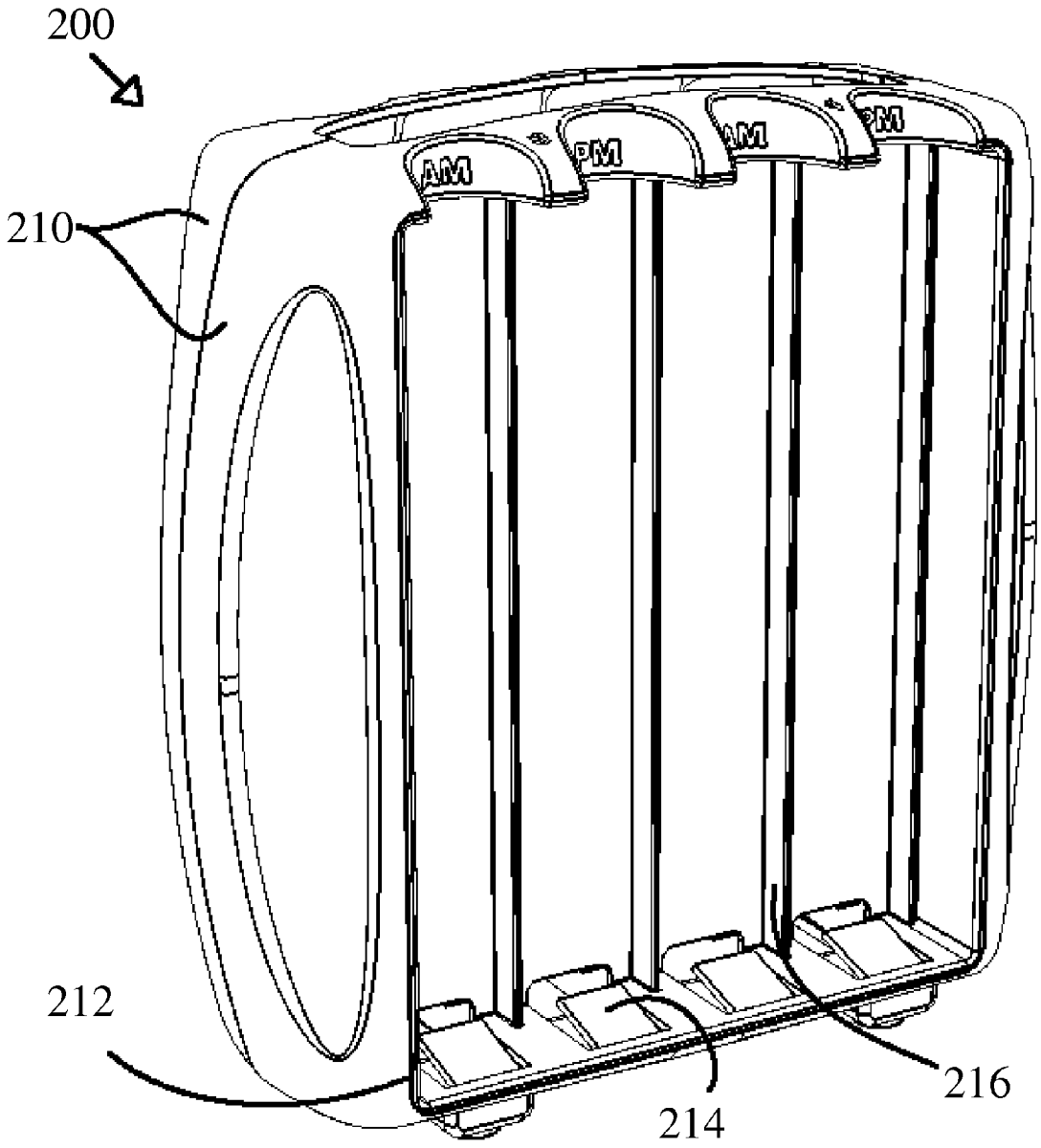
FIG. 2 illustrates a perspective view of one embodiment of a carrying compartment.

FIG. 2 illustrates an embodiment of a carrying compartment 200. A first and a second panel 210 are coupled to compose the carrying compartment 200. The first and second panels 210 each have a rectangular compartment (or cavity) 212 to house the pill cases. A first mount 214, a second mount (not shown), and a mounting rail 216 are coupled to (or disposed upon) the rectangular compartment 212.

Mounts

The first mount 214, shown in the FIG. 2, is coupled to the bottom of the rectangular compartment 212 at an upward angle, leaving a gap between the bottom of the first mount 214 and the bottom of the first panel 210. The first mount 214 is fixed at one end to rectangular compartment 212, while having the opposite end elevated from the first panel 210. While fixed at one end and freely elevated at the opposite end, the first mount 214 may provide a flexible resistance once a downward pressure is applied from the bottom of a pill case. This flexible resistance pushes up against the pill case allowing it to engage into the second mount as described below. The mounting rail 216 is attached longitudinally down the rectangular compartment 212. The first mount 214, the second mount (not shown), and the mounting rail 216 are used to hold in place the pill cases when inserted. Accordingly the first mounts 214, the second mounts (not shown), and the mounting rails 216 may be duplicated on the second panel 210 to house pill cases on both sides of the carrying compartment 200.

The inventor contemplates using plastic to form the first mount 214. This would allow the first mount 214 to be elastic, flexible, lightweight, cost efficient and durable. However, one skilled in the art would recognize that other materials may be used to effectuate an elastic, rigid yet flexible first mount 214.

Figure 3:
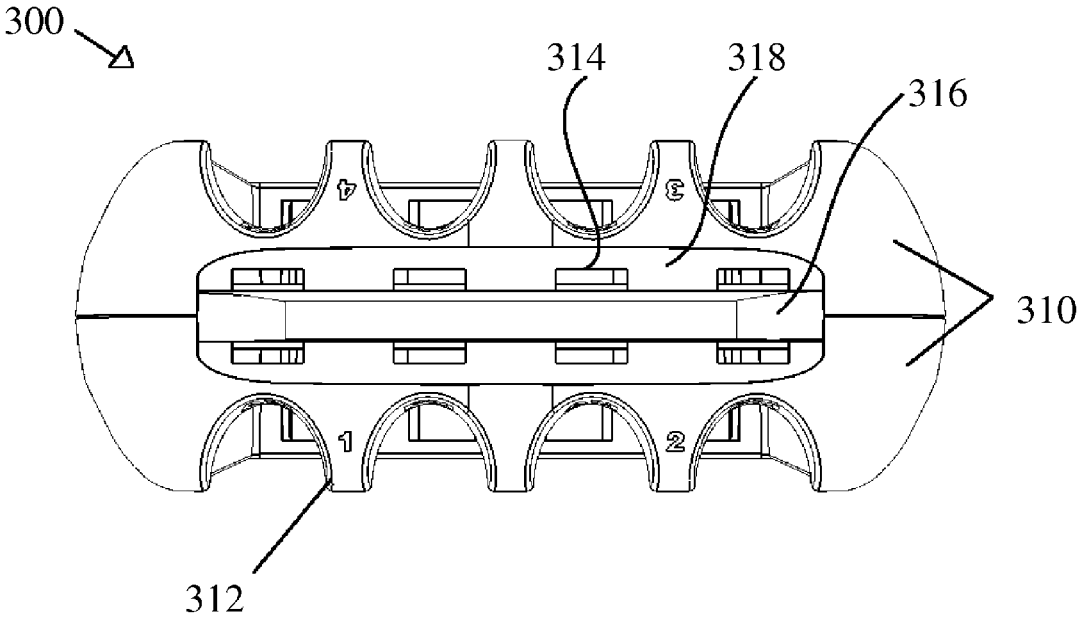
FIG. 3 depicts a top view of an embodiment of a carrying compartment.

FIG. 3 depicts a top view of a carrying compartment 300. A first and a complementary second panel 310 are coupled to compose the carrying compartment 300. The first and second panels 310 have arches 312 to allow for ease of insertion of pill cases into the carrying compartment 300. The carrying compartment 300 has a channel 316 formed between the backs of the first and the second panels 310. The channel 316 houses a drawer case (not shown). Surrounding the channel 316, the backs of the first and the second panel 310 have a recessed platform 318 to retain the drawer case. A second mount 314 is a slot, depicted here as rectangular in form, and is coupled to the back of the first and second panels 310 on the recessed platform 318. The second mount 314 allows the pill cases to snap into place, as described below.

Pill Cases

Figure 4A:
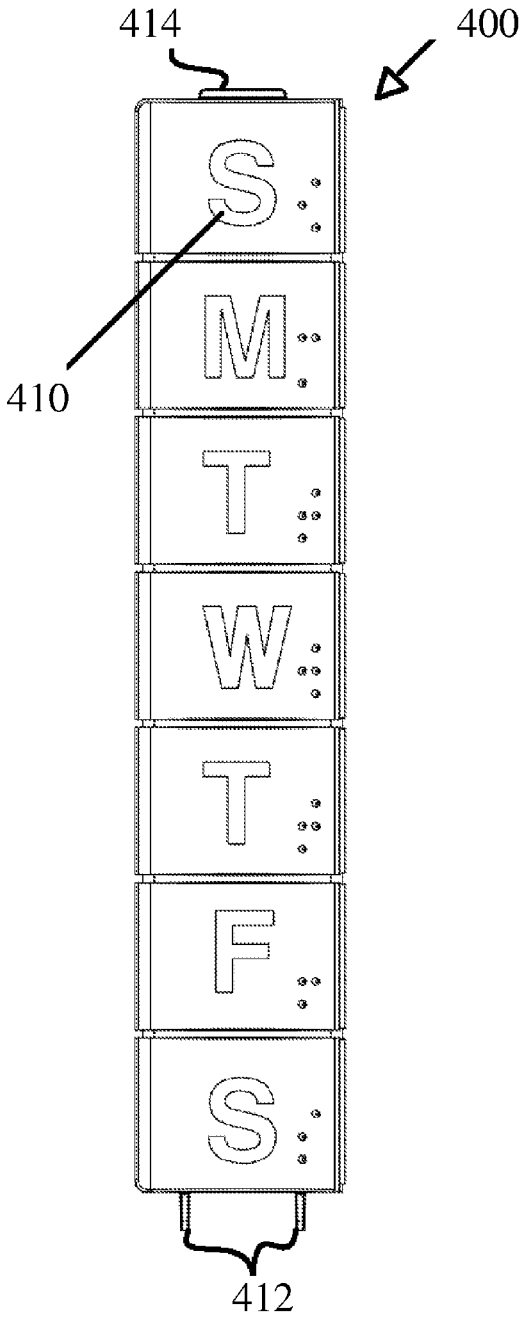
FIG. 4A shows one embodiment of a pill case in the closed position.

FIG. 4A shows a pill case 400 in the closed position. The pill case 400 may be formed with pill case indicia 410 to indicate a date or time at which the medicine should be dispensed. The pill case indicia 410 may include but are not limited to text, icons, Braille, or other symbols such as the letter "M" to indicate Monday or the letter "W" to indicate Wednesday. The pill case indicia 410 may be printed, affixed, embossed, or the like onto pill case 400. In addition the pill case 400 and/or its pill compartments may each be color coded for ease of determining the proper medicine to be retrieved or filled. A set of mounting prongs 412 is coupled to the bottom of the pill case 400. When the pill case 400 is inserted into the carrying compartment 200, depicted in the FIG. 2, the first mount 214 fits in between the mounting prongs 412. A mounting tab 414 is coupled to the rear of the top side of the pill case 400. The mounting tab 414 has a shape that is structurally complimentary to the second mount 314, shown in the FIG. 3. This allows for the mounting tab 414 to fit and snap into the second mount 313 once an upward pressure is applied on the pill case from the first mount 214, shown in FIG. 2.

Figure 4B:
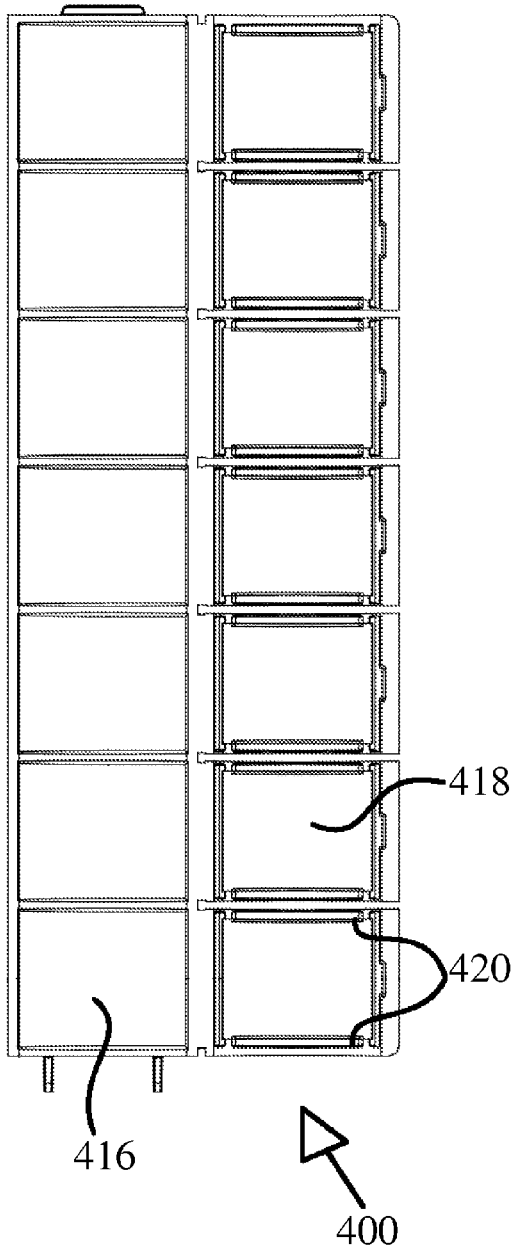
FIG. 4B shows one embodiment of a pill case in the opened position.

FIG. 4B shows a pill case 400 in the open position. The pill case 400 is composed of several compartments 416. Each of the compartments 416 has attached a lid 418. The lid 418 is attached at one end to the top surface of a compartment 416 forming a hinge. The hinge allows for the lid 418 to swing open exposing the interior of the compartment 416. Coupled to the interior of the lid 418 is a set of indicator rails 420, each having a lip facing the interior of the lid 418. The indicator rails 420 are used to hold the indicator (not shown) in place and allow for the indicator to move to along the inside of the lid 418 as described below. The bottom side of the compartments 416 may be partially curved to allow for easy removal of medication once the compartment 416 is opened.

Indicator

Figure 5:
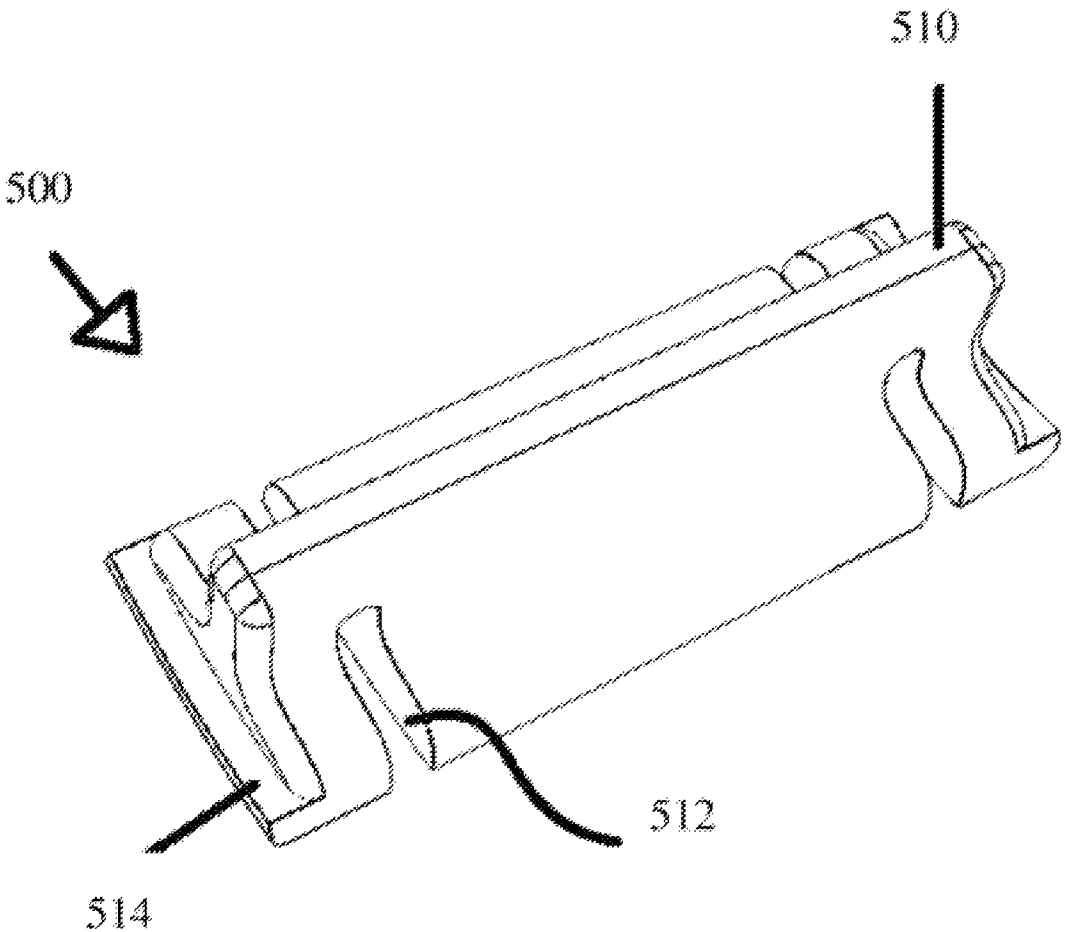
FIG. 5 depicts one embodiment of an indicator.

FIG. 5 depicts one embodiment of an indicator 500. Pill cases may have the indicator 500 to indicate whether the medicine dosage is correct. For example, if a user is short of medicine when filling the compartments on the pill case, the user may reposition the indicator 500 to indicate whether the proper medicine dosage is in the compartment or whether or not there is a shortage. Alternatively the user may place into the compartment a marker indicating the medicine is incomplete. The indicator 500, has a handgrip 510 fixed across the length of the indicator 500. The handgrip 510 is used by the user to hold the indicator 500 and reposition it. The indicator 500 also has grooves 512 that run down the width of the bottom of the indicator 500. The indicator 500 has a flange 514 coupled to each end. In order for the indicator 500 to couple with the lid 418 of the pill case in FIG. 4B, the flange 514 fits underneath the indicator rails 420, which holds the indicator 500 to the lid 418. The grooves 512 permit the indicator 500 to compress slightly when fitting the flanges 514 under the indicator rails 420. Once coupled, the indicator 500 may slide along the indicator rails 420 to be repositioned by the user.

Drawer Case

Figure 6:
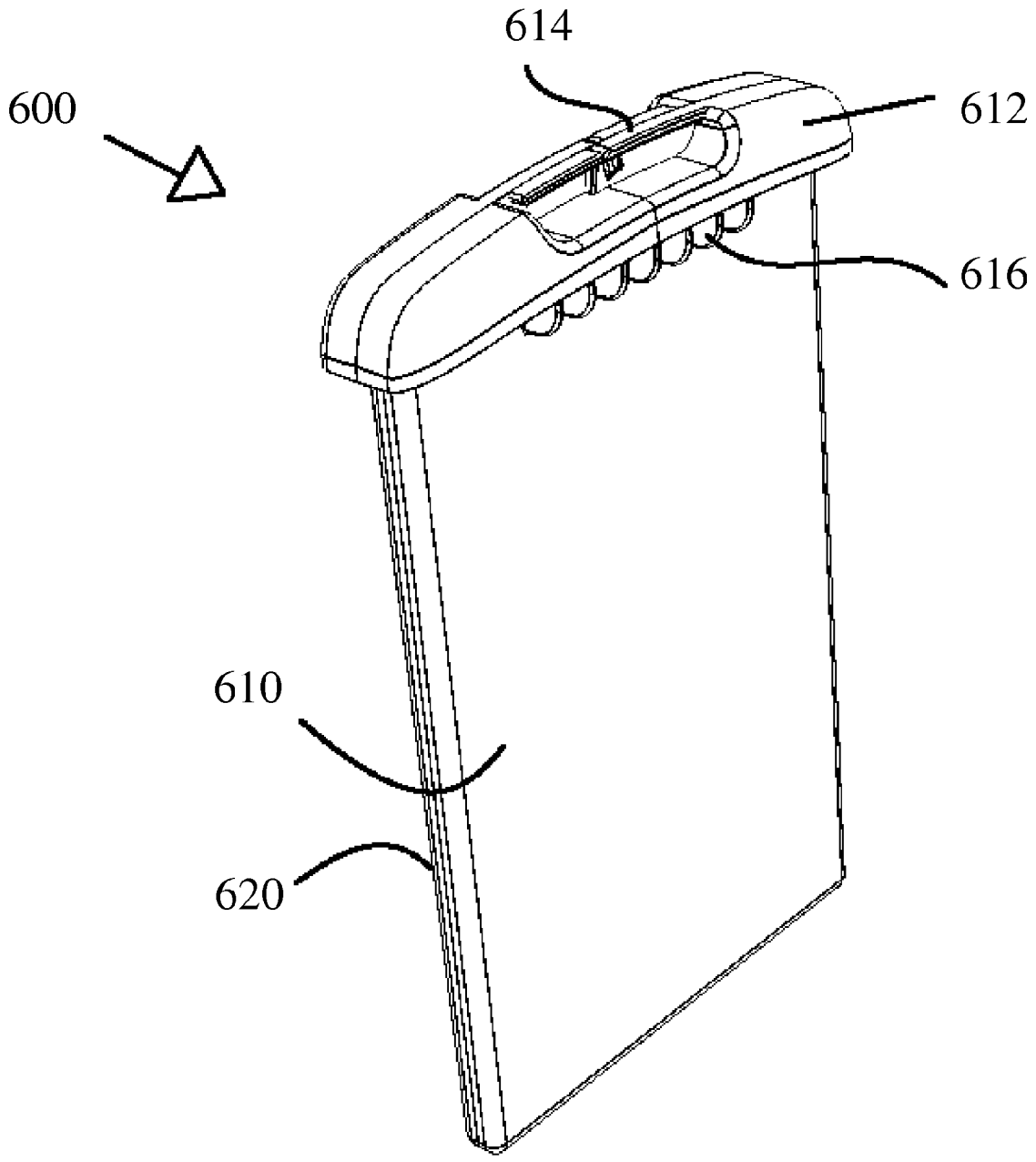
FIG. 6 illustrates an embodiment of a drawer case according to aspects of the current disclosure.

FIG. 6 illustrates a drawer case 600. The drawer case 600 may have a first panel 610 and a complementary second panel 620. Coupled to the top of each of the first panel 610 and the second panel 620 is a cap 612. The cap 612 of the first panel 610 is structurally complimentary to the cap 612 of the second panel 620. Each cap 612 has a locking mechanism 614. The locking mechanism 614 has a dual snap type fastener with a lip and groove. The locking mechanism 614 and its lip and groove on the first panel 610 is structurally complimentary to the locking mechanism 614 and its lip and groove on the second panel 620. When they come together the lip of the locking mechanism 614 on the first panel 610 snaps into the groove of the locking mechanism 614 on the second panel 620 and the lip of the locking mechanism 614 on the second panel 620 snaps into the groove of the locking mechanism 614 on the first panel 610, thus holding the first panel 610 and second panel 620 together until the user applies pressure to unsnap the lips and grooves. One skilled in the art would recognize that other locking mechanisms such as latch or other temporary fasteners could be used to temporarily connect the first panel 610 and the second panel 620.

A set of hanging prongs 616 are coupled to the bottom of the cap 612 and the top of the first panel 610 and second panel 620. The hanging prongs 616 provide structural support between the cap 612 and the first panel 610 or second panel 620. The hanging prongs 616 also act as a stoppage device; when the drawer case 600 is inserted into the channel 316 of FIG. 3, the hanging prongs 616 rest on the recessed platform 318 to stop the drawer case 600 from being fully submerged into the channel 316. Between the first panel 610 and second panel 620 is a compartment (not shown), which can hold various items such as a note pad or prescriptions.

In operation, the user removes the pill case 118 of FIG. 1 by pressing down on the top of the pill case 118, which will depress the first mount 214 of FIG. 2, thereby releasing the tab 414, of FIG. 4A, of the pill case 118 from the second mount 314 of FIG. 3. At this point the pill case 118 will be free to pull out from the carrying compartment 110. Then the user fills the pill case 118 with medicine in the appropriate compartments. If medicine is low or missing, the user may slide the indicator 120 of FIG. 1 from one side to the other of the pill case lid 418 of FIG. 4B. The user then places the pill case 118 back into the carrying compartment 110 by aligning the pill case 118 between the mounting rails 216 of FIG. 2 and pushing the pill case 118 down on the first mount 214 then snapping in the tab 414, of FIG. 4, of the pill case 118 into the second mount 314 of FIG. 3 to lock it into place. After which, the system may be compactly stored upright in a minimum of shelf or table-top space. The user may now retrieve the medicine as needed in an organized fashion by viewing the indicia 116 and pill cases 118 to determine which time and day to consume the medicine. Once the user has established which time and day they need, the pill case 118 may be removed as described above. The user then opens the specific compartment of the pill case 118, retrieves the medicine, closes the compartment and repeats the steps above to lock the pill case 118 back into the carrying compartment 110 for storage.

Additionally, the user may write notes or place prescriptions, or the like in the drawer case 122 of FIG. 1 by pulling out the drawer case 122 from the carrying compartment 110, unsnapping the locking mechanisms 614 of FIG. 6 much like a simple coin purse, and placing the prescriptions inside the drawer case 122 or writing notes on the note pad. Then the user closes the drawer case 122, by snapping together the locking mechanisms 614 and placing the drawer case 122 back into the carrying compartment 110.

The above illustration provides many different embodiments or embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. A device comprising:

a multi-compartment pill case;

a curved interior bottom panel disposed in each compartment of said multi-compartment pill case;

a cover, hingibly coupled to the multi-compartment pill case;

an indicia disposed on said cover;

a set of marker mounting rails coupled to the cover, said rails formed to receive a marker;

a first mount disposed on one end of the multi-compartment pill case;

a second mount disposed on an opposite end of the multi-compartment pill case, said first and second mounts formed to couple to a carrying case;

at least one marker, said marker removably disposed on the marker mounting rails, said marker operable to obscure at least a portion of the pill case, wherein the market is operable to slide along the rail.

* * * * *